US011669048B2

(12) United States Patent
Takasawa

(10) Patent No.: US 11,669,048 B2
(45) **Date of Patent: *Jun. 6, 2023**

(54) WATCH COMPONENT AND WATCH

(71) Applicant: Seiko Epson Corporation, Tokyo (JP)

(72) Inventor: Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 0 days.

This patent is subject to a terminal disclaimer.

(21) Appl. No.: 17/012,120

(22) Filed: Sep. 4, 2020

(65) Prior Publication Data

US 2021/0072702 A1 Mar. 11, 2021

(30) Foreign Application Priority Data

Sep. 5, 2019 (JP) ..... JP2019-162004

(51) Int. Cl.

| | |
|---|---|
| ***G04B 37/22*** | (2006.01) |
| ***C22C 38/48*** | (2006.01) |
| ***C22C 38/44*** | (2006.01) |
| ***C22C 38/42*** | (2006.01) |
| ***C22C 38/02*** | (2006.01) |
| ***C22C 38/00*** | (2006.01) |
| ***C22C 38/04*** | (2006.01) |
| ***C22C 38/40*** | (2006.01) |
| ***C21D 1/06*** | (2006.01) |

(52) U.S. Cl.

CPC ..... *G04B 37/22* (2013.01); *C21D 1/06* (2013.01); *C22C 38/001* (2013.01); *C22C 38/002* (2013.01); *C22C 38/02* (2013.01); *C22C 38/04* (2013.01); *C22C 38/40* (2013.01); *C22C 38/42* (2013.01); *C22C 38/44* (2013.01); *C22C 38/48* (2013.01); *C21D 2211/001* (2013.01); *Y10T 428/12958* (2015.01)

(58) Field of Classification Search

None

See application file for complete search history.

(56) References Cited

U.S. PATENT DOCUMENTS

| | | | | |
|---|---|---|---|---|
| 7,875,128 | B2 | 1/2011 | Kuroda et al. | |
| 8,303,168 | B2 | 11/2012 | Takasawa | |
| 2006/0130938 | A1 | 6/2006 | Kramer | |
| 2007/0217293 | A1 | 9/2007 | Takasawa | |
| 2017/0088912 | A1 * | 3/2017 | Fukuda | C22C 38/20 |

FOREIGN PATENT DOCUMENTS

| | | | | |
|---|---|---|---|---|
| JP | 2000-155182 | A | | 6/2000 |
| JP | 2005097682 | A | * | 4/2005 |
| JP | 2007-056301 | A | | 3/2007 |
| JP | 2007-248397 | A | | 9/2007 |
| JP | 2007239060 | A | * | 9/2007 |
| JP | 2009-069049 | A | | 4/2009 |
| JP | 2013-101157 | A | | 5/2013 |
| WO | WO-2021100687 | A1 | * | 5/2021 |

* cited by examiner

*Primary Examiner* — Xiaobei Wang

(74) *Attorney, Agent, or Firm* — Harness, Dickey & Pierce, P.L.C.

(57) ABSTRACT

A watch component includes a metal material obtained by performing a nitrogen absorption treatment on a base material, the base material being a ferritic stainless steel that contains, by mass %, 18 to 22% of Cr, 1.3 to 2.8% of Mo, 0.05 to 0.50% of Nb, less than 0.5% of Ni, less than 0.8% of Mn, less than 0.5% of Si, less than 0.10% of P, less than 0.05% of S, less than 0.05% of N, and less than 0.05% of C, with a remainder thereof being composed of Fe and an unavoidable impurity.

4 Claims, 3 Drawing Sheets

WATCH COMPONENT AND WATCH

The present application is based on, and claims priority from JP Application Serial Number 2019-162004, filed Sep. 5, 2019, the disclosure of which is hereby incorporated by reference herein in its entirety.

BACKGROUND

1. Technical Field

The present disclosure relates to a watch component and a watch.

2. Related Art

JP-A-2009-69049 discloses a housing, or more specifically, a shell and a case back, for a watch using ferritic stainless steel in which a surface layer is austenized by a nitrogen absorption treatment.

In JP-A-2009-69049, the surface layer of the ferritic stainless steel is austenized to obtain a hardness and corrosion resistance required for a housing for a watch.

In an austenization treatment using nitrogen gas, i.e., in a nitrogen absorption treatment, nitrogen enters the ferrite phase from the surface layer of the treatment target material, and the portion where the nitrogen concentration is greater than or equal to a prescribed nitrogen concentration changes to the austenized phase. Here, in the ferritic stainless steel of JP-A-2009-69049, the transfer rate of nitrogen into the ferrite phase is not uniform, and varies from place to place. As a result, a long nitrogen absorption treatment time is required to form an austenized phase of the thickness required for obtaining a hardness and corrosion resistance required for a housing for a watch in any portions of the surface layer.

SUMMARY

A watch component of the present disclosure includes a metal material obtained by performing a nitrogen absorption treatment on a base material, the base material being a ferritic stainless steel that contains, by mass %, 18 to 22% of Cr, 1.3 to 2.8% of Mo, 0.05 to 0.50% of Nb, 0.1 to 0.8% of Cu, less than 0.5% of Ni, less than 0.8% of Mn, less than 0.5% of Si, less than 0.10% of P, less than 0.05% of S, less than 0.05% of N, and less than 0.05% of C, with a remainder thereof being composed of Fe and an unavoidable impurity.

In the watch component of the present disclosure, the ferritic stainless steel may contain, by mass %, 20 to 22% of Cr, 1.8 to 2.8% of Mo, 0.05 to 0.35% of Nb, 0.1 to 0.2% of Cu, less than 0.2% of Ni, less than 0.5% of Mn, less than 0.3% of Si, less than 0.03% of P, less than 0.01% of S, less than 0.01% of N, and less than 0.02% of C.

In the watch component of the present disclosure, the ferritic stainless steel may contain, by mass %, 19.5 to 20.5% of Cr, 2.25 to 2.35% of Mo, 0.15 to 0.25% of Nb, 0.1 to 0.15% of Cu, less than 0.1% of Ni, less than 0.1% of Mn, less than 0.3% of Si, less than 0.03% of P, less than 0.01% of S, less than 0.01% of N, and less than 0.01% of C.

A watch of the present disclosure includes the watch component.

DESCRIPTION OF EXEMPLARY EMBODIMENTS

Embodiments

A watch 1 of an embodiment of the present disclosure will be described below with reference to the drawings.

Figure 1:
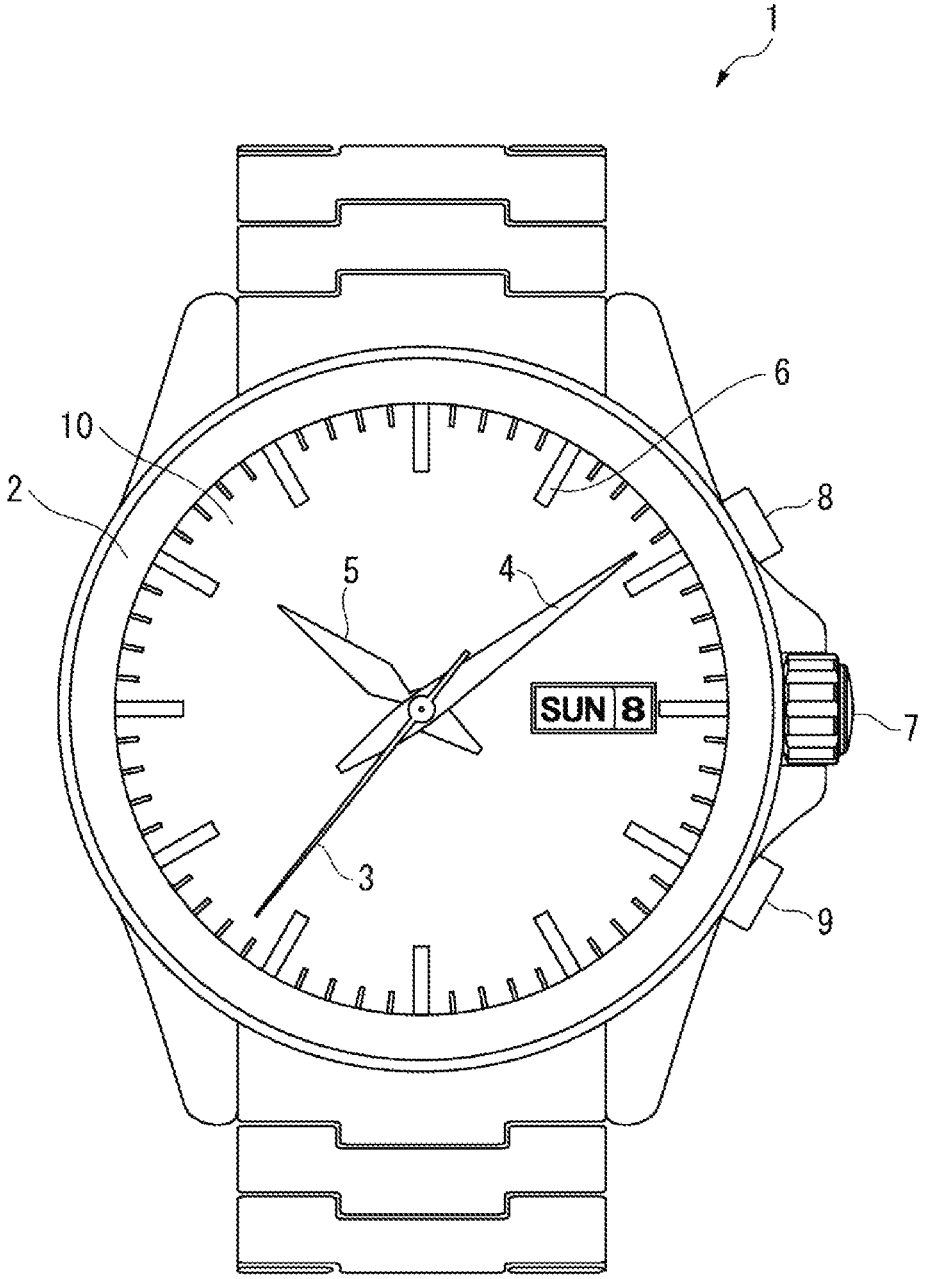
FIG. 1 is a front view illustrating a watch of an embodiment.

FIG. 1 is a front view illustrating the watch 1. In this embodiment, the watch 1 is configured as a wristwatch that is worn on the user's wrist.

As illustrated in FIG. 1, the watch 1 includes a metal case 2. In addition, inside the case 2, a disk-shaped dial 10, a second hand 3, a minute hand 4, a hand needle 5, a crown 7, an A-button 8 and a B-button 9 are provided. Note that the case 2 is an example of a watch component of the present disclosure.

The dial 10 is provided with an hour mark 6 for indicating the time of day.

Next, the reason for limiting the composition of the ferritic stainless steel as a base material of the metallic material that constitutes the case 2, which is the watch component of the present disclosure, is explained. Unless otherwise noted, the notation of % means mass %.

Cr is an element that increases the transfer rate of nitrogen to the ferrite phase and the diffusion rate of nitrogen in the ferrite phase in the nitrogen absorption treatment. When Cr is less than 18%, the transfer rate and diffusion rate of nitrogen is low. Further, when Cr is less than 18%, the corrosion resistance as a material of ferritic stainless steel in which a surface layer is austenized is reduced. On the other hand, when the Cr exceeds 22%, it is hardened and the workability as the material is degraded. Further, when the Cr exceeds 22%, the aesthetic appearance is impaired. Therefore, the content of Cr is preferably 18 to 22%, more preferably 20 to 22%, even more preferably 19.5 to 20.5%.

Mo is an element that increases the transfer rate of nitrogen to the ferrite phase and the diffusion rate of nitrogen in the ferrite phase in the nitrogen absorption treatment. When Mo is less than 1.3%, the transfer rate and diffusion rate of nitrogen is low. Further, when Mo is less than 1.3%, the corrosion resistance as the material is reduced. On the other hand, when Mo exceeds 2.8%, it is hardened and the workability as the material is degraded. Further, when Mo exceeds 2.8%, the heterogeneity of the compositional structure of the austenized phase becomes significant and the aesthetic appearance is impaired. Therefore, the content of Mo is preferably 1.3 to 2.8%, more preferably 1.8 to 2.8%, even more preferably 2.25 to 2.35%.

Nb is an element that increases the transfer rate of nitrogen to the ferrite phase and the diffusion rate of nitrogen in the ferrite phase in the nitrogen absorption treatment. When Nb is less than 0.05%, the transfer rate and diffusion rate of nitrogen is low. On the other hand, when Nb exceeds 0.50%, it is hardened and the workability as the material is degraded. Further, precipitates are formed and the aesthetic appearance is impaired. Therefore, the content of Nb is preferably 0.05 to 0.50%, more preferably 0.05 to 0.35%, even more preferably 0.15 to 0.25%.

Cu is an element that controls the absorption of nitrogen in the ferrite phase in the nitrogen absorption treatment. When Cu is less than 0.1%, the variation in nitrogen content in the ferrite phase increases. On the other hand, when Cu exceeds 0.8%, the transfer rate of nitrogen to the ferrite phase is low. Therefore, the content of Cu is preferably 0.1 to 0.8%, more preferably 0.1 to 0.2%, even more preferably 0.1 to 0.15%.

Ni is an element that inhibits the transfer of nitrogen to the ferrite phase and the diffusion of nitrogen in the ferrite phase in the nitrogen absorption treatment. When Ni is 0.5% or greater, the transfer rate and diffusion rate of nitrogen are reduced. Further, the corrosion resistance may be degraded, and it may be difficult to prevent the occurrence of metal allergies and the like. Therefore, the content of Ni is preferably less than 0.5%, more preferably less than 0.2%, even more preferably less than 0.1%.

Mn is an element that inhibits the transfer of nitrogen to the ferrite phase and the diffusion of nitrogen in the ferrite phase in the nitrogen absorption treatment. When Mn is 0.8% or greater, the transfer rate and diffusion rate of nitrogen are reduced. Therefore, the content of Mn is preferably less than 0.8%, more preferably less than 0.5%, even more preferably less than 0.1%.

Si is an element that inhibits the transfer of nitrogen to the ferrite phase and the diffusion of nitrogen in the ferrite phase in the nitrogen absorption treatment. When Si is 0.5% or greater, the transfer rate and diffusion rate of nitrogen are reduced. Therefore, the content of Si is preferably less than 0.5%, more preferably less than 0.3%.

P is an element that inhibits the transfer of nitrogen to the ferrite phase and the diffusion of nitrogen in the ferrite phase in the nitrogen absorption treatment. When P is 0.10% or greater, the transfer rate and diffusion rate of nitrogen are reduced. Therefore, the content of P is preferably less than 0.10%, more preferably less than 0.03%.

S is an element that inhibits the transfer of nitrogen to the ferrite phase and the diffusion of nitrogen in the ferrite phase in the nitrogen absorption treatment. When S is 0.05% or greater, the transfer rate and diffusion rate of nitrogen are reduced. Therefore, the content of S is preferably less than 0.05%, more preferably less than 0.01%.

N is an element that inhibits the transfer of nitrogen to the ferrite phase and the diffusion of nitrogen in the ferrite phase in the nitrogen absorption treatment. When N is 0.05% or greater, the transfer rate and diffusion rate of nitrogen are reduced. Therefore, the content of N is preferably less than 0.05%, more preferably less than 0.01%.

C is an element that inhibits the transfer of nitrogen to the ferrite phase and the diffusion of nitrogen in the ferrite phase in the nitrogen absorption treatment. When C is 0.05% or greater, the transfer rate and diffusion rate of nitrogen are reduced. Therefore, the content of C is preferably less than 0.05%, more preferably less than 0.02%, even more preferably less than 0.01%.

Next, specific examples of the present disclosure are described.

Example 1

Figure 2:
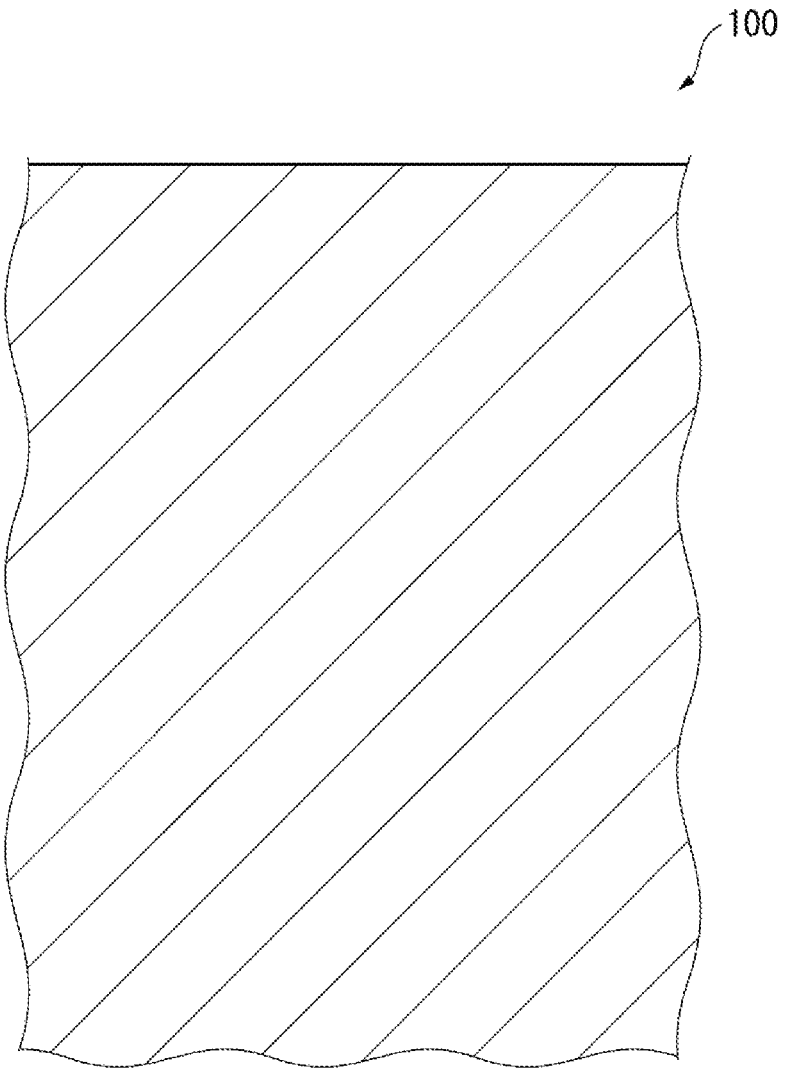
FIG. 2 is a cross-sectional view illustrating a base material of Example 1.

First, as shown in FIG. 2, a base material 100 composed of ferritic stainless steel containing 20% Cr, 2.1% Mo, 0.2% Nb, 0.1% Cu, 0.05% Ni, 0.5% Mn, 0.3% Si, 0.03% P, 0.01% S, 0.01% N, and 0.02% C, with the remainder composed of Fe and unavoidable impurities was produced.

Figure 3:
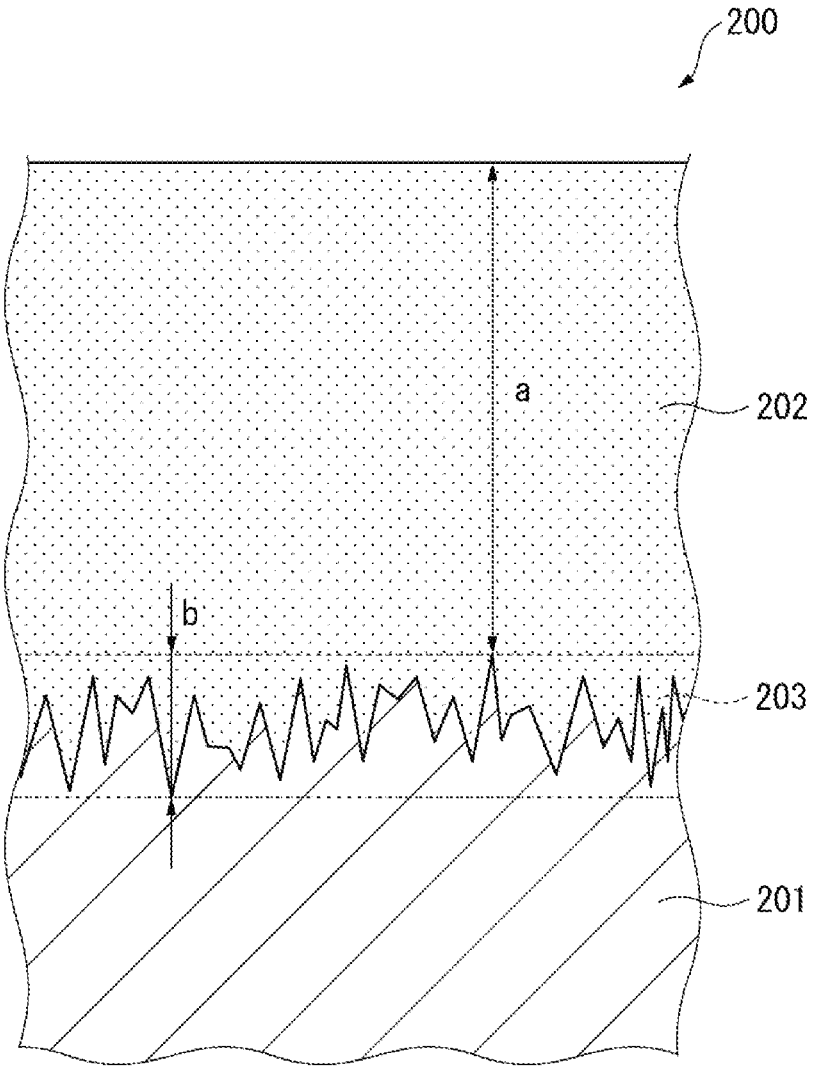
FIG. 3 is a cross-sectional view illustrating a metal material of Example 1.

Next, by applying a nitrogen absorption treatment to the base material 100, a metal material 200 including a base 201 composed of a ferrite phase, an austenized surface layer 202 formed on a surface of the base 201, and a mixed layer 203 in which the ferrite phase and the austenized phase are mixed was obtained as illustrated in FIG. 3.

The nitrogen absorption treatment was performed by the method described below.

First, a nitrogen absorption treatment device including a treatment chamber surrounded by a heat insulating material such as glass fibers, a heating means for heating the treatment chamber, a vacuum means for reducing the pressure inside the treatment chamber, and a nitrogen gas introduction means for introducing nitrogen gas into the treatment chamber was prepared.

Next, the base material 100 illustrated in FIG. 2 was placed in the treatment chamber of the nitrogen absorption treatment device, and then the pressure inside the treatment chamber was reduced to 2 Pa by a pressure reducing means.

Next, nitrogen gas was introduced by the nitrogen gas introduction means while exhausting the inside of the treatment chamber by the pressure reducing means, and the pressure inside the treatment chamber was maintained at 0.08 to 0.12 MPa. In this state, the temperature inside the treatment chamber was raised to 1200° C. at a rate of 5° C./minute by the heating means.

Then, the temperature was maintained at 1200° C. for 4.0 hours, which is the treatment time determined for setting a thickness a of a thinnest portion in the surface layer 202 illustrated in FIG. 3 to 450 μm. Note that the treatment time of 4.0 hours was determined through a preliminary test. In addition, the reason that the thickness a of the surface layer 202 was set to 450 μm is that this value was determined in a preliminary experiment as a value that can achieve the corrosion resistance and the hardness required for the watch component in the case where the metal material 200 is used as the watch component for a case or the like.

The base material 100 was then quenched by water cooling. In this manner, the metal material 200 in which the austenized surface layer 202 is formed on the surface of the base 201 was obtained as illustrated in FIG. 3. Note that the thickness b of the mixed layer 203 illustrated in FIG. 3 indicates the distance from the deepest point of the austenized phase formed in a concave and convex form to the shallowest point of the austenized phase, i.e., to the thickness a of the surface layer 202. In other words, the thickness b of the mixed layer 203 indicates the amount of variation in the austenized phase.

Examples 2 to 10

A metal material was obtained by setting the composition of the ferritic stainless steel constituting the base material as shown in Table 1, and by applying a nitrogen absorption treatment similar to that of Example 1 to the base material. Note that the treatment times in Example 2 to 10 were determined through preliminary tests.

Comparative Examples 1 to 3

A metal material was obtained by setting the composition of the ferritic stainless steel constituting the base material as shown in Table 1, and by applying a nitrogen absorption treatment similar to that of Example 1 to the base material. Note that the treatment times of Comparative Examples 1 to 3 were determined through preliminary tests.

Measurement of Thickness a of Surface Layer and Thickness b of Mixed Layer

A given portion of the metal material produced in each of Examples and Comparative Examples was cut from the surface along the depth direction, i.e., along the direction orthogonal to the surface, and then the cut surface was polished. Thereafter, the thickness a of the surface layer and the thickness b of the mixed layer in the cut surface were measured through observation of the structure of the cut surface with SEM. Then, the ratio of the thickness b of the mixed layer with respect to the thickness a of the surface layer, i.e. "b/a" was determined. Here, the thickness a of the surface layer is the thickness of the layer composed of the austenized phase, and is the shortest distance from the surface of the surface layer to the ferrite phase of the mixed layer in the field of view in SEM observation at a magnification of 500 to 1000, for example. Alternatively, the thickness a of the surface layer may be set to an average value of the distances measured at a plurality of points where the distance from the surface of the surface layer to the ferrite phase of the mixed layer is short. In addition, the thickness b of the mixed layer is the thickness of the layer in which the ferrite phase and the austenized phase are mixed, and is the longest distance from the boundary of the surface layer and the mixed layer, i.e., the thickness a, to the ferrite phase of the mixed layer in the field of view in SEM observation at a magnification of 500 to 1000, for example. Alternatively, the thickness b of the mixed layer may be set to an average value of the distances measured at a plurality of points where the distance from the surface of the surface layer to the ferrite phase of the mixed layer is long.

Note that when observing the structure of the cut surface, the ferrite phase may be etched using an etching agent. This clarifies the boundary between the austenized phase and the ferrite phase, thus making it easier to observe the structure of the cut surface.

Measurement of Nitrogen Content

The nitrogen content of the austenized surface layer was measured using an inert gas melting thermal conductivity method for the metal materials produced in Examples and Comparative Examples.

TABLE 1

| | Content [mass %] | | | | | | | | | | |
|---|---|---|---|---|---|---|---|---|---|---|---|
| | Cr | Mo | Nb | Cu | Ni | Mn | Si | P | S | N | C |
| Example 1 | 20 | 2.1 | 0.2 | 0.1 | 0.05 | 0.5 | 0.3 | 0.030 | 0.010 | 0.01 | 0.02 |
| Example 2 | 18 | 2.0 | 0.2 | 0.1 | 0.05 | 0.5 | 0.3 | 0.030 | 0.010 | 0.01 | 0.01 |
| Example 3 | 22 | 2.3 | 0.2 | 0.1 | 0.05 | 0.5 | 0.3 | 0.030 | 0.010 | 0.01 | 0.03 |
| Example 4 | 19 | 2.3 | 0.2 | 0.1 | 0.05 | 0.8 | 0.3 | 0.030 | 0.010 | 0.01 | 0.03 |
| Example 5 | 20 | 1.9 | 0.2 | 0.1 | 0.05 | 0.5 | 0.3 | 0.040 | 0.010 | 0.01 | 0.03 |
| Example 6 | 20 | 2.6 | 0.2 | 0.1 | 0.05 | 0.5 | 0.3 | 0.030 | 0.010 | 0.01 | 0.03 |
| Example 7 | 19 | 2.5 | 0.4 | 0.1 | 0.23 | 0.5 | 0.0 | 0.050 | 0.010 | 0.01 | 0.05 |
| Example 8 | 18 | 2.2 | 0.3 | 0.1 | 0.05 | 0.5 | 0.5 | 0.030 | 0.010 | 0.02 | 0.02 |
| Example 9 | 21 | 2.4 | 0.1 | 0.1 | 0.05 | 0.5 | 0.3 | 0.030 | 0.040 | 0.01 | 0.02 |
| Example 10 | 21 | 2.1 | 0.3 | 0.1 | 0.50 | 0.6 | 0.3 | 0.030 | 0.010 | 0.01 | 0.02 |
| Comparative Example 1 | 25.3 | — | 0.0 | 0.01 | 0.01 | 0.2 | 0.5 | 0.009 | 0.001 | 0.02 | 0.03 |
| Comparative Example 2 | 18.3 | 2.3 | 0.2 | — | — | 0.3 | 0.2 | 0.022 | 0.001 | 0.02 | 0.01 |
| Comparative Example 3 | 25.8 | 2.0 | — | — | <0.01 | — | — | <0.002 | 0.002 | 0.02 | 0.00 |

Evaluation Results

Evaluation results for Examples and Comparative Examples are shown in Table 2.

As shown in Table 2, in Examples 1 to 10 of the present disclosure, the thickness b of the mixed layer is 126 to 199 μm, and b/a is 28 to 44%. On the other hand, in Comparative Examples 1 to 3, the thickness b of the mixed layer is 400 to 1260 μm, and b/a is 89 to 280%. A conceivable reason for this is that in Comparative Example 1, Mo was less than 1.3% and that the transfer rate and diffusion rate of nitrogen were reduced. In addition, a conceivable reason is that in Comparative Example 2, Cu was less than 0.1%, and consequently the variation in nitrogen in the ferrite phase was significant. Further, a conceivable reason is that in Comparative Example 3, Nb was less than 0.05%, and consequently the transfer rate and diffusion rate of nitrogen were reduced.

This suggests that in Examples 1 to 10 of the present disclosure, the austenized surface layer was uniformly formed compared to Comparative Examples 1 to 3. A conceivable reason for this is that, as shown in Table 2, in the compositions of Example 1 to 10 of the present disclosure, the transfer of nitrogen to the ferrite phase and the diffusion of nitrogen in the ferrite phase were facilitated since the nitrogen content of the surface layer is greater than the comparative example.

This suggests that in Examples 1 to 10 of the present disclosure, the treatment time of the nitrogen absorption treatment taken until the thickness a of the surface layer reached 450 μm was 3.7 to 4.7 hours, and the treatment time can be significantly reduced compared to Comparative Examples 1 to 3 in which the treatment time was 10.0 to 12.0 hours.

TABLE 2

| | Surface Layer a [μm] | Mixed Layer b [μm] | b/a [%] | Treatment Time [hr] |
|---|---|---|---|---|
| Example 1 | 450 | 130 | 29 | 4.0 |
| Example 2 | 450 | 134 | 30 | 4.3 |
| Example 3 | 450 | 184 | 41 | 3.7 |
| Example 4 | 450 | 199 | 44 | 4.1 |
| Example 5 | 450 | 126 | 28 | 4.2 |
| Example 6 | 450 | 178 | 40 | 3.8 |
| Example 7 | 450 | 178 | 39 | 4.7 |

TABLE 2-continued

| | Surface Layer a [μm] | Mixed Layer b [μm] | b/a [%] | Treatment Time [hr] |
|---|---|---|---|---|
| Example 8 | 450 | 184 | 41 | 4.1 |
| Example 9 | 450 | 165 | 37 | 4.4 |
| Example 10 | 450 | 173 | 38 | 4.6 |
| Comparative Example 1 | 450 | 1260 | 280 | 12.0 |
| Comparative Example 2 | 450 | 400 | 89 | 10.0 |
| Comparative Example 3 | 450 | 1050 | 233 | 12.0 |

Modification Example

Note that the present disclosure is not limited to each of the embodiments described above, and variations, modifications, and the like within the scope in which the object of the present disclosure can be achieved are included in the present disclosure.

In the embodiments described above, the watch component of the present disclosure is configured as the case 2, but the present disclosure is not limited thereto. For example, the watch component of the present disclosure may be configured as a bezel, a case back, a band, a crown, a button, or the like.

In the embodiments described above, the metal material whose base member is composed of ferritic stainless steel of the present disclosure constitutes a watch component, but the present disclosure is not limited thereto. For example, the metal material of the present disclosure may constitute a case of an electronic device other than a watch, i.e., a component of an electronic device such as a housing. With a housing composed of such a metal material, the electronic device can have a high hardness and corrosion resistance.

What is claimed is:

1. A metal material comprising a base material, the base material being a ferritic stainless steel that contains, by mass %, 18 to 22% of Cr, 1.55 to 2.8% of Mo, 0.30 to 0.50% of Nb, 0.1 to 0.8% of Cu, less than 0.5% of Ni, less than 0.8% of Mn, less than 0.5% Si, less than 0.10% of P, less than 0.05% of S, less than 0.05% of N, and less than 0.05% of C, with a remainder thereof being composed of Fe and unavoidable impurities, wherein the base material is treated with a nitrogen absorption treatment.

2. The metal material according to claim 1, wherein the ferritic stainless steel contains, by mass %, 20 to 22% of Cr, 1.8 to 2.8% of Mo, 0.30 to 0.35% of Nb, 0.1 to 0.2% of Cu, less than 0.2% of Ni, less than 0.5% of Mn, less than 0.3% of Si, less than 0.03% of P, less than 0.01% of S, less than 0.01% of N, and less than 0.02% of C.

3. A watch comprising the metal material according to claim 1.

4. A watch comprising the metal material according to claim 2.

* * * * *